US011543138B2

(12) United States Patent
Kawaguchi

(10) Patent No.: US 11,543,138 B2
(45) Date of Patent: Jan. 3, 2023

(54) OUTDOOR UNIT FOR AIR-CONDITIONING APPARATUS

(71) Applicant: Mitsubishi Electric Corporation, Tokyo (JP)

(72) Inventor: Yohei Kawaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 330 days.

(21) Appl. No.: 16/644,274

(22) PCT Filed: Nov. 15, 2017

(86) PCT No.: PCT/JP2017/041138
§ 371 (c)(1),
(2) Date: Mar. 4, 2020

(87) PCT Pub. No.: WO2019/097614
PCT Pub. Date: May 23, 2019

(65) Prior Publication Data

US 2020/0200404 A1 Jun. 25, 2020

(51) Int. Cl.
*F24F 1/16* (2011.01)
*F24F 1/30* (2011.01)
(Continued)

(52) U.S. Cl.
CPC ..... *F24F 1/16* (2013.01); *F24F 1/30* (2013.01); *F24F 1/56* (2013.01); *F24F 13/20* (2013.01); *F24F 13/30* (2013.01); *F24F 13/32* (2013.01)

(58) Field of Classification Search
CPC ..... F24F 1/16; F24F 1/30; F24F 1/56; F24F 13/20; F24F 13/30; F24F 13/32; F24F 1/40; F24F 1/46
See application file for complete search history.

(56) References Cited

U.S. PATENT DOCUMENTS

2015/0040609 A1* 2/2015 Yamauchi ..... F24F 1/58 62/508
2016/0146512 A1* 5/2016 Kitabatake ..... F24F 1/40 62/498

FOREIGN PATENT DOCUMENTS

CN 2725760 Y 9/2005
CN 104272032 A 1/2015
(Continued)

OTHER PUBLICATIONS

Japanese Office Action dated Dec. 22, 2020, issued in corresponding JP Patent Application No. 2019-554102 (and English Machine Translation).
(Continued)

*Primary Examiner* — Kun Kai Ma
(74) *Attorney, Agent, or Firm* — Posz Law Group, PLC

(57) ABSTRACT

An outdoor unit for an air-conditioning apparatus according to the present disclosure includes a heat exchanger comprised of an upper heat exchanger and a lower heat exchanger that are arranged in an up-down direction, an accumulator configured to store refrigerant, a casing, an inside of which is partitioned by a partition plate into an air-sending chamber accommodating the heat exchanger and a machine chamber accommodating the accumulator, and a fixing component configured to be fixed to the heat exchanger and the accumulator so that the accumulator is fixed to the heat exchanger, wherein the fixing component is fixed to both of the upper heat exchanger and the lower heat exchanger.

3 Claims, 10 Drawing Sheets

(51) Int. Cl.

| | |
|---|---|
| ***F24F 1/56*** | (2011.01) |
| ***F24F 13/20*** | (2006.01) |
| ***F24F 13/30*** | (2006.01) |
| ***F24F 13/32*** | (2006.01) |

(56) References Cited

FOREIGN PATENT DOCUMENTS

| | | | | |
|---|---|---|---|---|
| EP | 2 042 820 | A2 | 4/2009 | |
| EP | 2042820 | A2 * | 4/2009 | ..... F24F 1/10 |
| JP | H04-095229 | U | 8/1992 | |
| JP | H08-334294 | A | 12/1996 | |
| JP | H10-332230 | A | 12/1998 | |
| JP | 2001-124445 | A | 5/2001 | |
| JP | 2007-322041 | A | 12/2007 | |
| JP | 2009-085465 | A | 4/2009 | |
| KR | 10-2007-0077409 | A | 7/2007 | |

OTHER PUBLICATIONS

Chinese Office Action dated Dec. 29, 2020, issued in corresponding CN Patent Application No. 201780096607.6 (and English Machine Translation).

Office Action dated Jul. 27, 2021 issued in corresponding CN patent application No. 201780096607.6 (and English translation).

International Search Report of the International Searching Authority dated Feb. 20, 2018 in corresponding International Patent Application No. PCT/JP2017/041138 (and English translation).

Office Action dated May 14, 2021 issued in corresponding CN patent application No. 201780096607.6 (and English translation).

* cited by examiner

OUTDOOR UNIT FOR AIR-CONDITIONING APPARATUS

CROSS REFERENCE TO RELATED APPLICATION

This application is a U.S. national stage application of PCT/JP2017/041138 filed on Nov. 15, 2017, the contents of which are incorporated herein by reference.

TECHNICAL FIELD

The present disclosure relates to an outdoor unit for an air-conditioning apparatus, and more particularly, to a fixing structure of an accumulator provided in the outdoor unit for an air-conditioning apparatus.

BACKGROUND ART

Some of typical outdoor units for an air-conditioning apparatus are provided with an accumulator configured to store surplus refrigerant during operation. In particular, outdoor units for an air-conditioning apparatus that allow for individual control of a plurality of indoor units is provided with an accumulator configured to store surplus refrigerant during operation. In the typical outdoor unit for an air-conditioning apparatus, the inside of a casing is partitioned by a partition plate into an air-sending chamber accommodating a heat exchanger and other devices therein and a machine chamber accommodating a compressor and other devices therein. The accumulator is accommodated in, for example, the machine chamber.

For example, from the viewpoint of reducing the size of the machine chamber, the conventional outdoor unit for an air-conditioning apparatus may have a configuration in which the accumulator is fixed to a component forming a side wall of the machine chamber without being directly provided on a lower surface portion of the casing. For example, in the outdoor unit for an air-conditioning apparatus disclosed in Patent Literature 1, the accumulator is fixed to the partition plate. In addition, there is also known a conventional outdoor unit for an air-conditioning apparatus having a configuration in which the accumulator accommodated in the machine chamber is fixed to a heat exchanger.

CITATION LIST

Patent Literature

Patent Literature 1: Japanese Unexamined Patent Application Publication No. 2009-85465

SUMMARY OF INVENTION

Technical Problem

For example, as the capacity of the air-conditioning apparatus is increased, the heat exchanger of the outdoor unit may be increased in size. In such a case, the heat exchanger of the outdoor unit may be comprised of two heat exchangers arranged in an up-down direction due to manufacturing constraints of the heat exchanger. That is, the heat exchanger of the outdoor unit may be comprised of a lower heat exchanger and an upper heat exchanger disposed above the lower heat exchanger. In the case where the accumulator is to be fixed to the heat exchanger being thus comprised of the upper heat exchanger and the lower heat exchanger in the conventional configuration, the accumulator accommodated in the machine chamber is fixed to one of the upper heat exchanger or the lower heat exchanger.

The size of the accumulator is increased in proportion to an amount of refrigerant circulating through a refrigerant circuit of the air-conditioning apparatus, that is, in proportion to the size of the heat exchanger of the outdoor unit. This is because a maximum amount of surplus refrigerant that may be generated during operation is increased. Therefore, the accumulator provided in the outdoor unit for an air-conditioning apparatus that includes the upper heat exchanger and the lower heat exchanger is increased in size, which leads to an increase in weight. Accordingly, when such an accumulator having a large weight is fixed to the heat exchanger in the conventional configuration, the following problems occur.

As described above, in the outdoor unit for an air-conditioning apparatus that includes the upper heat exchanger and the lower heat exchanger, when the accumulator accommodated in the machine chamber is to be fixed to the heat exchanger in the conventional configuration, the accumulator is fixed to one of the upper heat exchanger and the lower heat exchanger. Therefore, the weight of the accumulator is supported by only one of the upper heat exchanger and the lower heat exchanger. The vibration of the accumulator generated during transportation or operation of the air-conditioning apparatus acts on only one of the upper heat exchanger and the lower heat exchanger. Accordingly, in the outdoor unit for an air-conditioning apparatus that includes the upper heat exchanger and the lower heat exchanger, when the accumulator accommodated in the machine chamber is to be fixed to the heat exchanger in the conventional configuration, the upper heat exchanger or lower heat exchanger to which the accumulator is fixed may be damaged.

An object of an outdoor unit of the present disclosure, which has been made to overcome the above problems, is to provide an outdoor unit for an air-conditioning apparatus capable of preventing damage to an upper heat exchanger and a lower heat exchanger even when an accumulator is fixed to a heat exchanger being comprised of the upper heat exchanger and the lower heat exchanger.

Solution to Problem

An outdoor unit for an air-conditioning apparatus of an embodiment of the present disclosure includes a heat exchanger comprised of an upper heat exchanger and a lower heat exchanger that are arranged in an up-down direction, an accumulator configured to store refrigerant, a casing, an inside of which is partitioned by a partition plate into an air-sending chamber accommodating the heat exchanger and a machine chamber accommodating the accumulator, and a fixing component configured to be fixed to the heat exchanger and the accumulator so that the accumulator is fixed to the heat exchanger, wherein the fixing component is fixed to both of the upper heat exchanger and the lower heat exchanger.

Advantageous Effects of Invention

In an outdoor unit for an air-conditioning apparatus of an embodiment of the present disclosure, an accumulator accommodated in a machine chamber is fixed to both of an upper heater exchanger and a lower heat exchanger by a fixing component. Therefore, the outdoor unit for an air-conditioning apparatus of the embodiment of the present disclosure can prevent the accumulator from being supported by only one of the upper heat exchanger and the lower heat exchanger. Moreover, in the outdoor unit for an air-conditioning apparatus of an embodiment of the present disclosure, the vibration of the accumulator generated during transportation or operation of the air-conditioning apparatus can be prevented from acting on only one of the upper heat exchanger and the lower heat exchanger. Accordingly, the outdoor unit for an air-conditioning apparatus of the embodiment of the present disclosure can prevent the upper heat exchanger and lower heat exchanger from being damaged.

DESCRIPTION OF EMBODIMENTS

Figure 1:
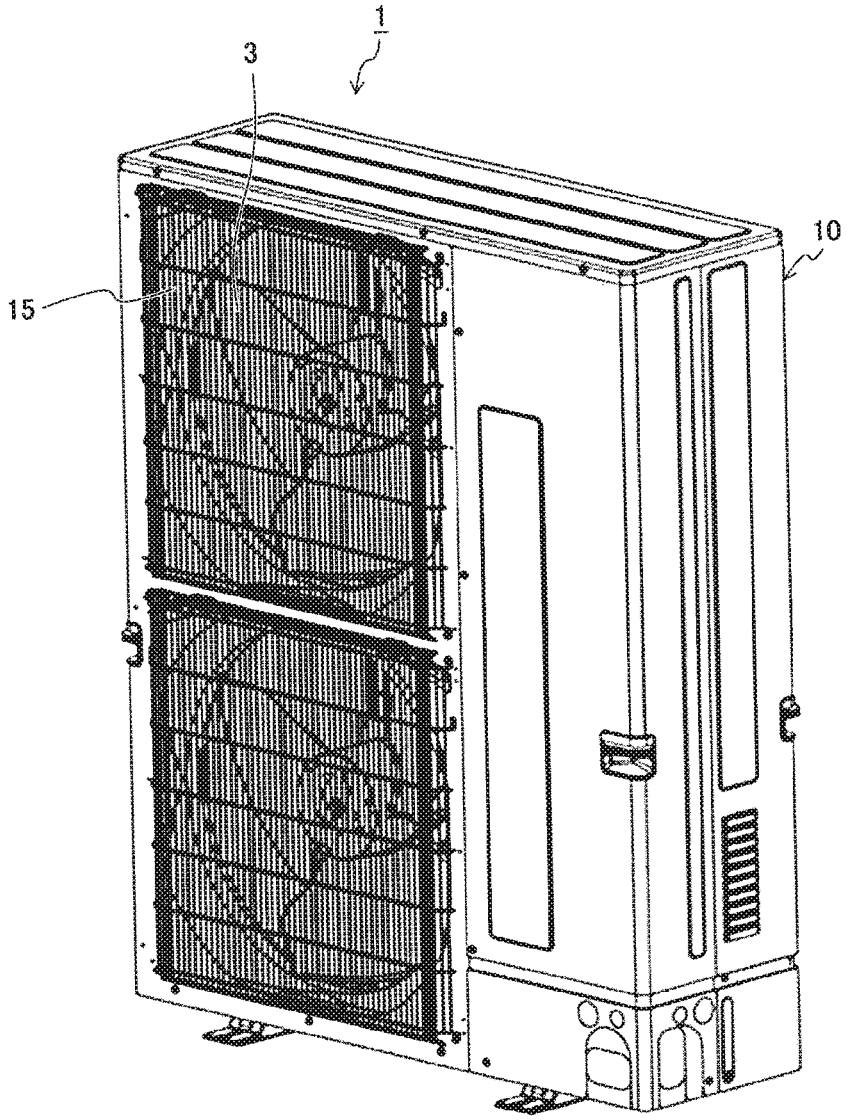
FIG. 1 is a perspective view illustrating an outdoor unit for an air-conditioning apparatus according to an embodiment of the present disclosure when the outdoor unit is viewed from the front of the outdoor unit.
Figure 2:
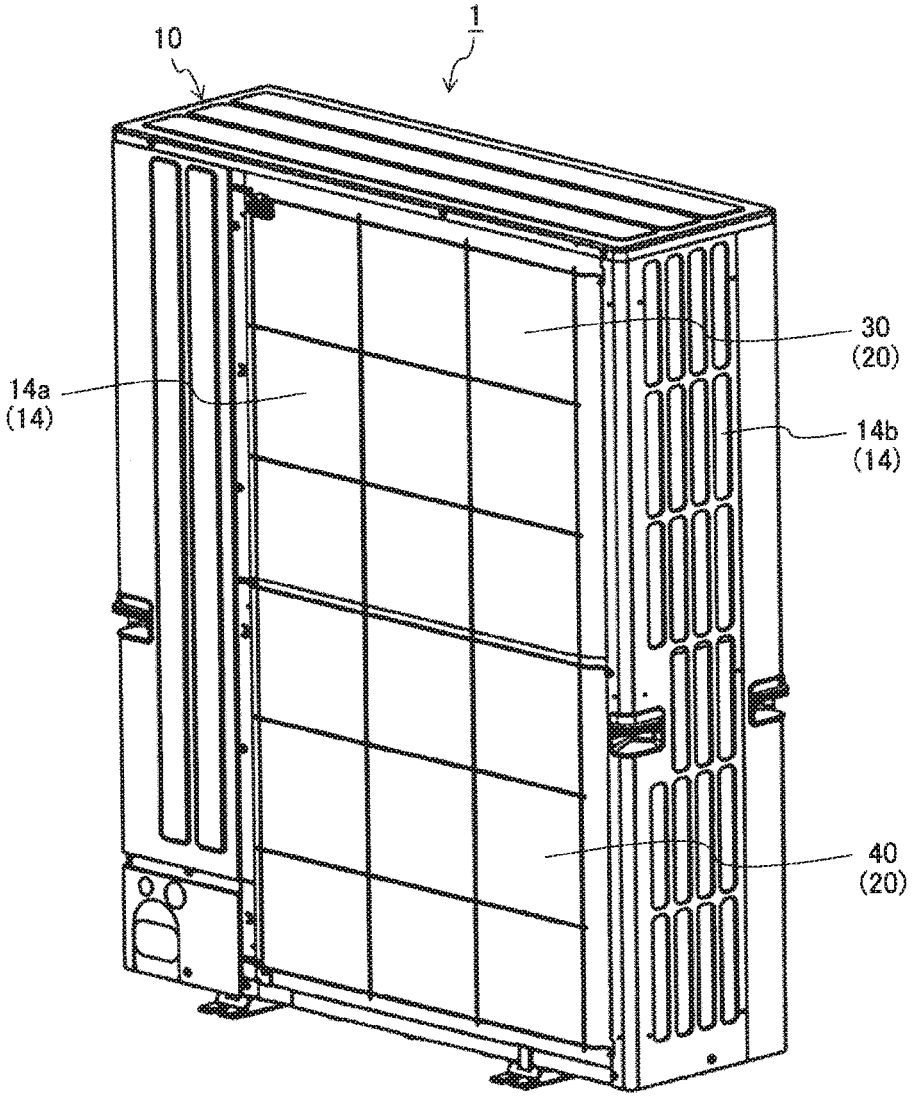
FIG. 2 is a perspective view illustrating the outdoor unit for an air-conditioning apparatus according to the embodiment of the present disclosure when the outdoor unit is viewed from the rear side of the outdoor unit.
Figure 3:
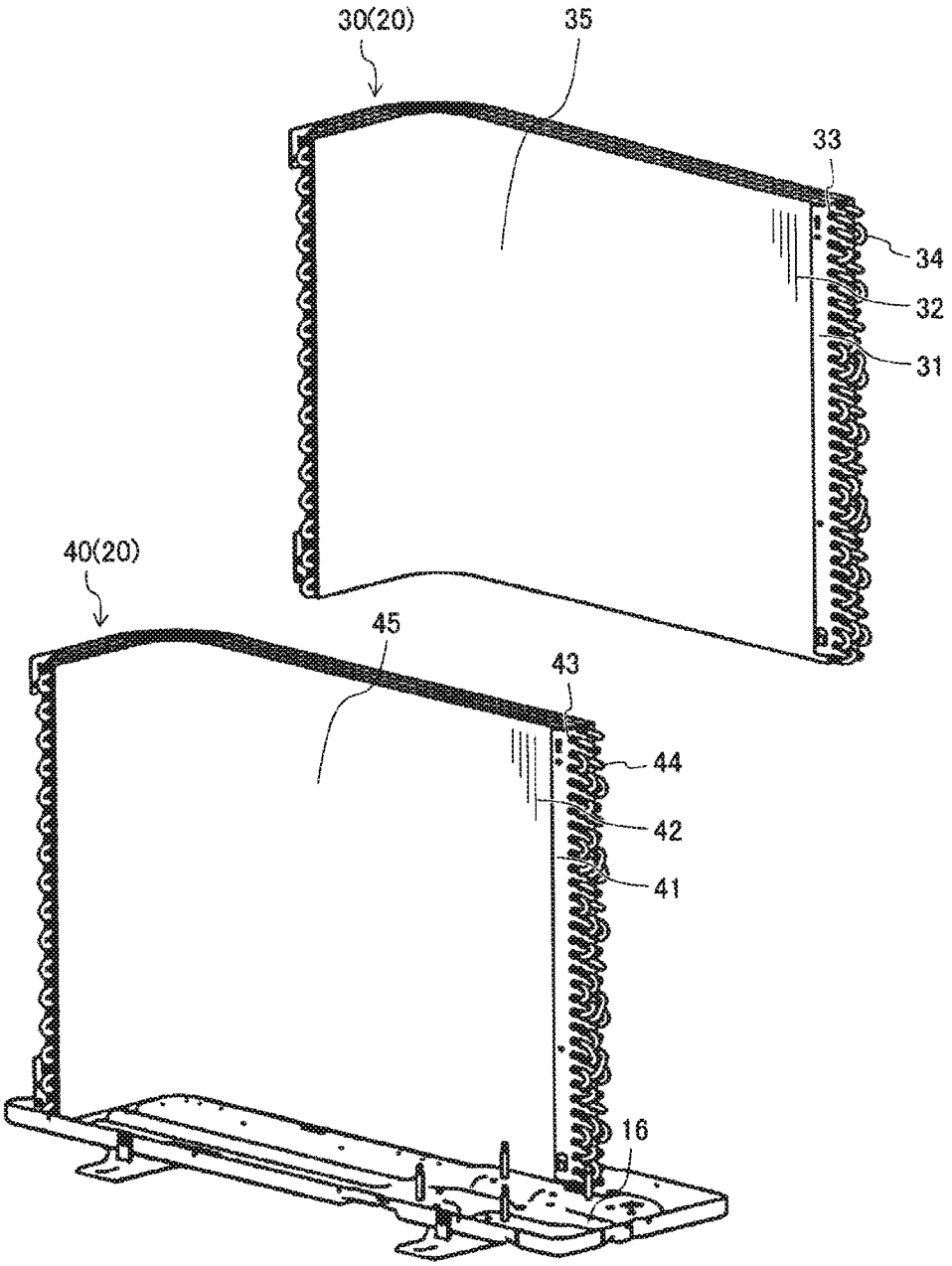
FIG. 3 is an exploded perspective view illustrating a heat exchanger of the outdoor unit for an air-conditioning apparatus according to the embodiment of the present disclosure when the heat exchanger is viewed from the front of the heat exchanger.
Figure 4:
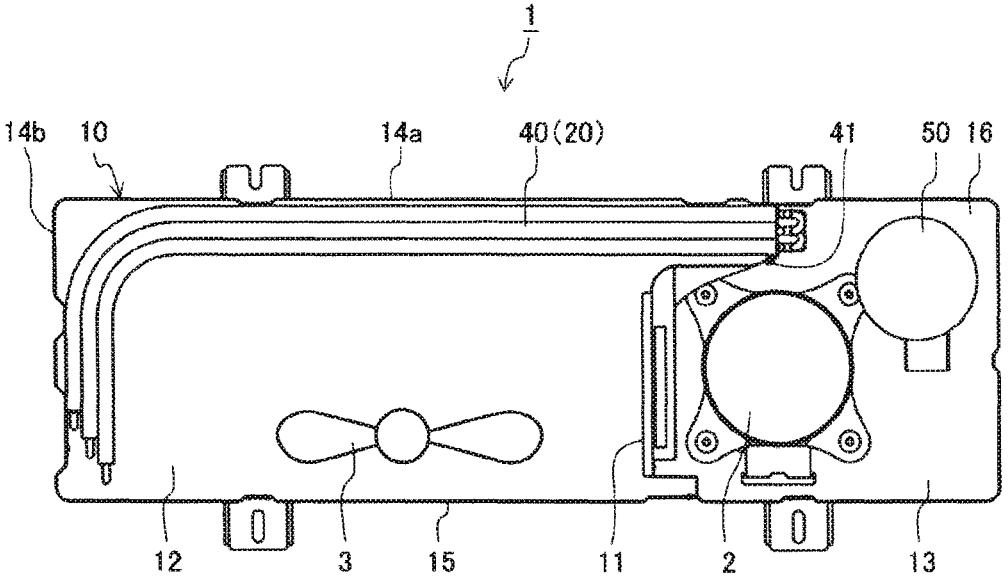
FIG. 4 is a cross-sectional view illustrating the outdoor unit for an air-conditioning apparatus according to the embodiment of the present disclosure.

FIG. 1 is a perspective view illustrating an outdoor unit for an air-conditioning apparatus according to an embodiment of the present disclosure when the outdoor unit is viewed from the front of the outdoor unit. FIG. 2 is a perspective view illustrating the outdoor unit for an air-conditioning apparatus according to the embodiment of the present disclosure when the outdoor unit is viewed from the rear side of the outdoor unit. FIG. 3 is an exploded perspective view illustrating a heat exchanger of the outdoor unit for an air-conditioning apparatus according to the embodiment of the present disclosure when the heat exchanger is viewed from the front of the heat exchanger. FIG. 4 is a cross-sectional view illustrating the outdoor unit for an air-conditioning apparatus according to the embodiment of the present disclosure. Note that FIG. 4 is a diagram of an outdoor unit 1 that is cut in the lateral direction at a position of a lower heat exchanger 40 described later and is observed from above.

The outdoor unit 1 for an air-conditioning apparatus includes, for example, a casing 10 having a substantially cuboid shape. An air outlet 15 is formed in a front surface portion of the casing 10. Note that in the present embodiment, two air outlets 15 are formed. Two outdoor fans 3 are accommodated in the casing 10 to face the respective air outlets 15. Each of the two outdoor fans 3 is, for example, a propeller fan. A position in a height direction of one of rotation axes of the two outdoor fans 3 is disposed at a position substantially identical to a center in the height direction of an upper heat exchanger 30 described later. A position in the height direction of the other rotation axis of the two outdoor fans 3 is disposed at a position substantially identical to a center in the height direction of the lower heat exchanger 40 described later.

An air inlet 14 is also formed in the casing 10. A heat exchanger 20 is accommodated in the casing 10 to face the air inlet 14. Note that in the present embodiment, an air inlet 14*a* and an air inlet 14*b* are formed as the air inlet 14. The air inlet 14*a* is formed in a rear surface portion of the casing 10. The air inlet 14*b* is formed in a side surface portion of the casing 10. Therefore, the heat exchanger 20 disposed to face the air inlet 14 is formed into a substantially L shape in plan view. That is, when the outdoor fan 3 is driven, outdoor air is sucked into the casing 10 from the air inlet 14. Then, the outdoor air having been sucked into the casing 10 passes through the heat exchanger 20, and thereafter is blown from the air outlet 15 toward outside of the casing 10.

The heat exchanger 20 according to the present embodiment includes the lower heat exchanger 40 provided on a bottom plate 16 forming a lower surface portion of the casing 10, and the upper heat exchanger 30 provided above of the lower heat exchanger 40. That is, the heat exchanger 20 includes the upper heat exchanger 30 and the lower heat exchanger 40 that are arranged in the up-down direction. Note that the upper heat exchanger 30 and the lower heat exchanger 40 are not limited to particular types, but in the present embodiment, each of the upper heat exchanger 30 and the lower heat exchanger 40 is a fin-and-tube heat exchanger.

More specifically, the upper heat exchanger 30 includes a plurality of upper heat exchanger units 35 that are arranged side by side along a flow direction of air flowing in the casing 10 at driving of the outdoor fan 3. Each of the upper heat exchanger units 35 includes a plurality of heat transfer fins 32 that are arranged side by side at predetermined intervals in the lateral direction, and a plurality of heat transfer tubes 33 that extend through the heat transfer fins 32 in an arrangement direction of the heat transfer fins 32. End portions of the heat transfer tubes 33 are connected by U-shaped connecting pipes 34, for example. The upper heat exchanger 30 includes an end plate 31 that is provided in an end portion on a closer side to a machine chamber 13 described later to connect each of the upper heat exchanger units 35. More specifically, the end plate 31 is disposed to face the heat transfer 32 that is the closest to the machine chamber 13 side in each of the upper heat exchanger units 35. Note that the upper heat exchanger 30 may be comprised of one upper heat exchanger unit 35.

Here, the end plate 31 corresponds to a first end plate of the present disclosure.

Similarly, the lower heat exchanger 40 includes a plurality of lower heat exchanger units 45 that are arranged side by side along a flow direction of air flowing in the casing 10 at driving of the outdoor fan 3. Each of the lower heat exchanger units 45 includes a plurality of heat transfer fins 42 that are arranged side by side at predetermined intervals in the lateral direction, and a plurality of heat transfer tubes 43 that extend through the heat transfer fins 42 in an arrangement direction of the heat transfer fins 42. End portions of the heat transfer tubes 43 are connected by U-shaped connecting pipes 44, for example. The lower heat exchanger 40 includes an end plate 41 that is provided in an end portion on a closer side to the machine chamber 13 described later to connect each of the lower heat exchanger units 45. More specifically, the end plate 41 is disposed to face the heat transfer fin 42 that is the closest to the machine chamber 13 side in each of the lower heat exchanger units 45. Note that the lower heat exchanger 40 may be comprised of one lower heat exchanger unit 45.

Here, the end plate 41 corresponds to a second end plate of the present disclosure.

In relation to detailed description of the inside of the casing 10, as illustrated in FIG. 4, the inside of the casing 10 is partitioned by a partition plate 11 into an air-sending chamber 12 and a machine chamber 13. The air-sending chamber 12 accommodates the above-described heat exchanger 20 and outdoor fan 3. That is, the air inlet 14 and the air outlet 15 are formed in a portion forming the air-sending chamber 12 in the casing 10. The machine chamber 13 accommodates an accumulator 50 configured to store surplus refrigerant. In the present embodiment, the machine chamber 13 also accommodates a compressor 2. Note that in the present embodiment, a rear side end portion of the partition plate 11 is fixed to the end plate 31 of the upper heat exchanger 30 and the end plate 41 of the lower heat exchanger 40 by, for example, screwing. That is, the end plate 31 of the upper heat exchanger 30 and the end plate 41 of the lower heat exchanger 40 have a function of partitioning into the air-sending chamber 12 and the machine chamber 13, together with the partition plate 11.

In the outdoor unit 1 according to the present embodiment, the accumulator 50 accommodated in the machine chamber 13 is fixed to the heat exchanger 20 by a fixing component 60. Hereinafter, a fixing structure of the accumulator 50 to the heat exchanger 20 will be described in detail.

Figure 5:
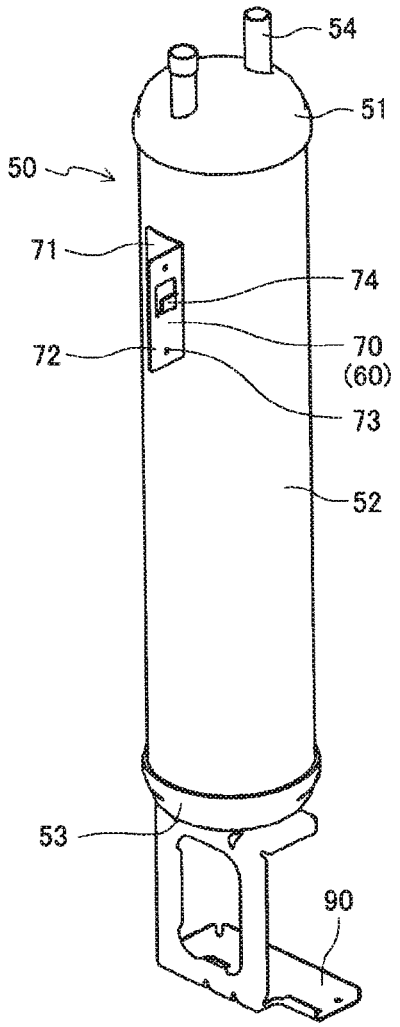
FIG. 5 is a perspective view illustrating an accumulator of the outdoor unit for an air-conditioning apparatus according to the embodiment of the present disclosure.

FIG. 5 is a perspective view illustrating the accumulator of the outdoor unit for an air-conditioning apparatus according to the embodiment of the present disclosure.

Figure 6:
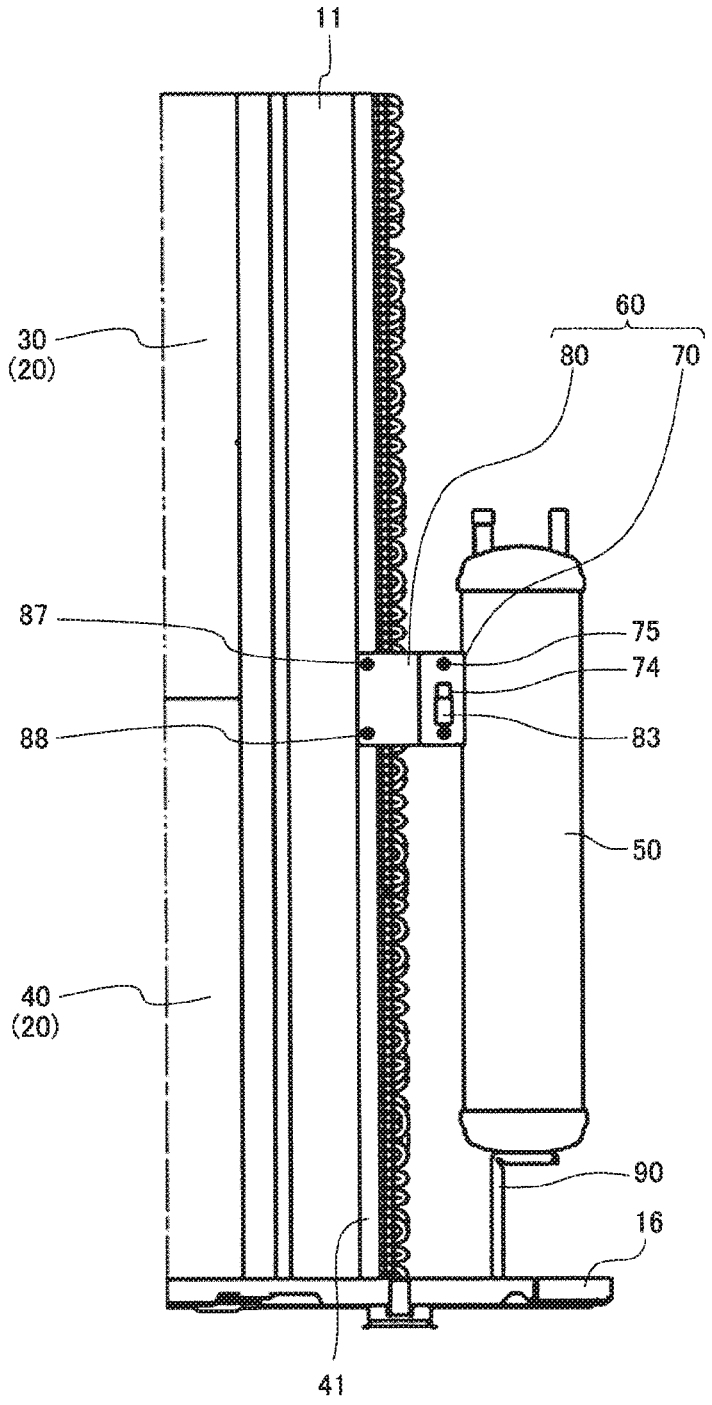
FIG. 6 is a front view illustrating the vicinity of a fixing portion between the heat exchanger and the accumulator in the outdoor unit for an air-conditioning apparatus according to the embodiment of the present disclosure.
Figure 7:
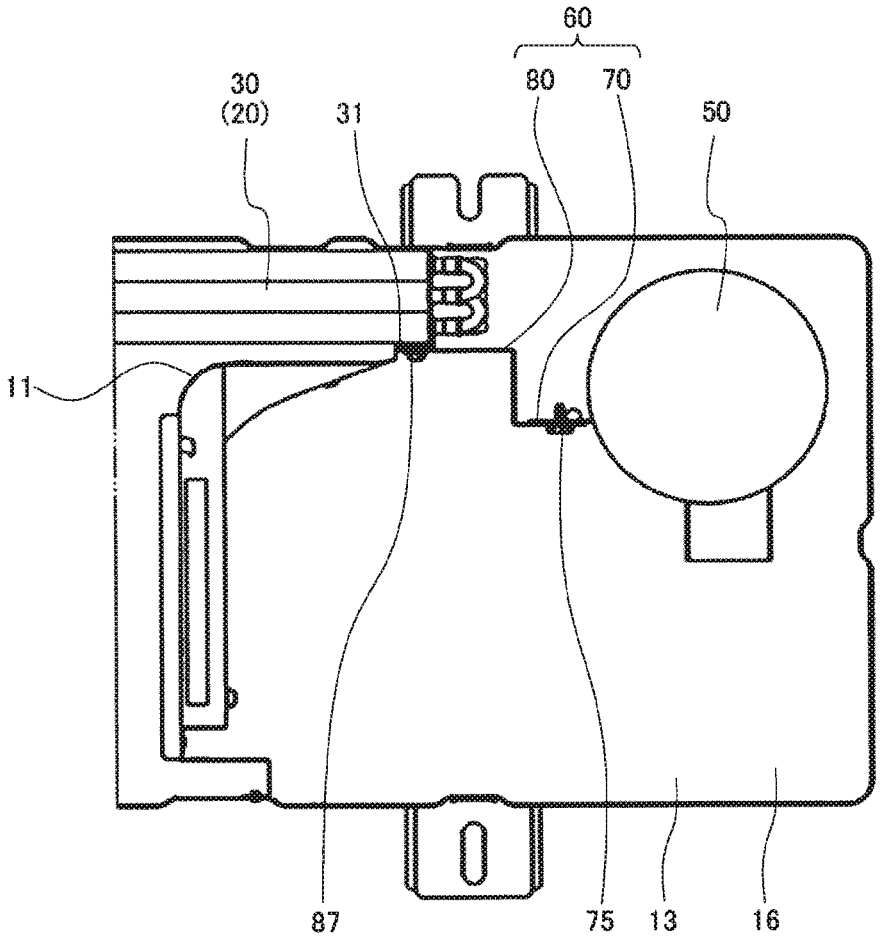
FIG. 7 is a plan view illustrating the vicinity of a fixing portion between the heat exchanger and the accumulator in the outdoor unit for an air-conditioning apparatus according to the embodiment of the present disclosure.
Figure 8:
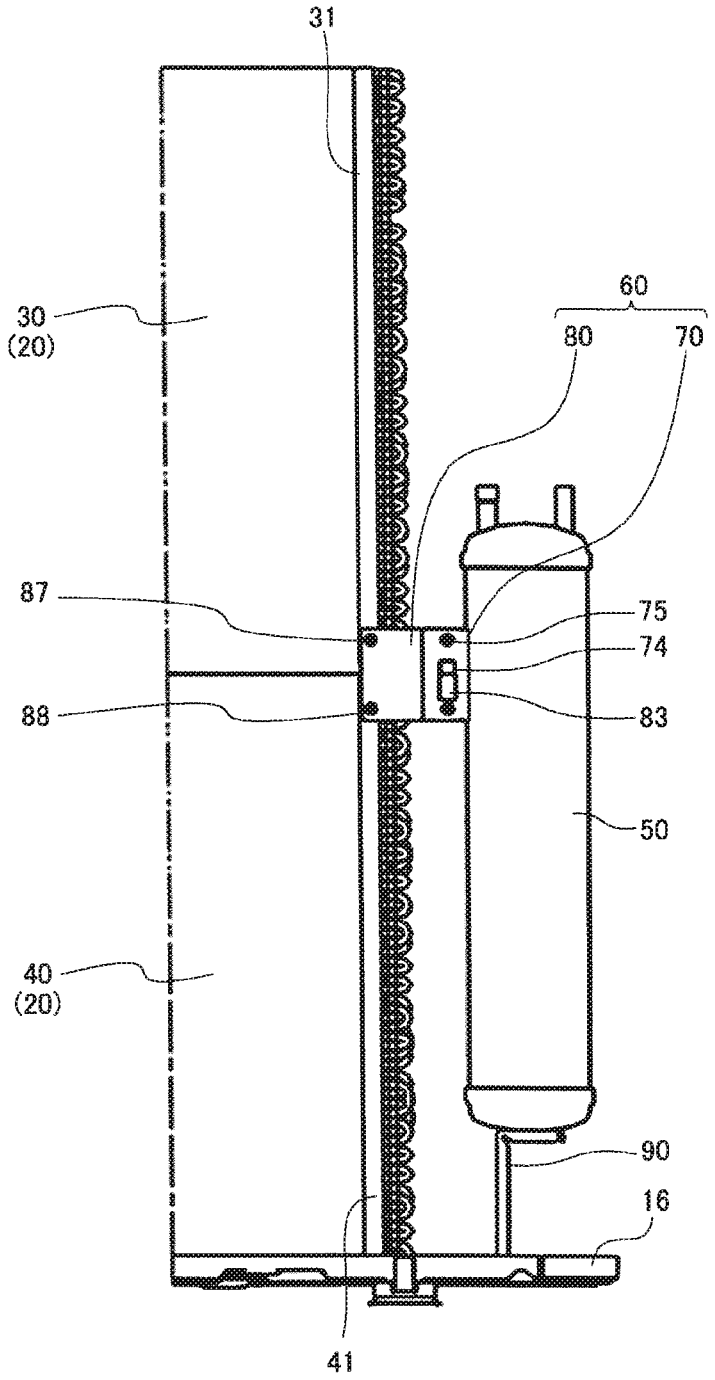
FIG. 8 is a diagram with a partition plate omitted from FIG. 6.

FIG. 6 is a front view illustrating the vicinity of a fixing portion between the heat exchanger and the accumulator in the outdoor unit for an air-conditioning apparatus according to the embodiment of the present disclosure. FIG. 7 is a plan view illustrating the vicinity of a fixing portion between the heat exchanger and the accumulator in the outdoor unit for an air-conditioning apparatus according to the embodiment of the present disclosure. FIG. 8 is a diagram with the partition plate omitted from FIG. 6. Note that FIG. 5 also illustrates a first fixing component 70 forming part of the fixing component 60, and a support component 90, in addition to the accumulator 50.

As illustrated in FIG. 5, the accumulator 50 includes, for example, an upper id component 51, a cylindrical component 52, a lower lid component 53, and a connecting pipe 54. The cylindrical component 52 is a component formed in a cylindrical shape. The upper lid component 51 is a component forming an upper surface portion of the accumulator 50 to close an upper opening of the cylindrical component 52. The lower lid component 53 is a component forming a lower surface portion of the accumulator 50 to close a lower opening of the cylindrical component 52. The connecting pipe 54 is a component connected with a refrigerant pipe forming the refrigerant circuit to allow communication between the inside of the accumulator 50 and the refrigerant circuit.

As illustrated in FIG. 6 to FIG. 8, the outdoor unit 1 includes the fixing component 60 fixed to the heat exchanger 20 and the accumulator 50. That is, the accumulator 50 is fixed to the heat exchanger 20 by the fixing component 60. The fixing component 60 is fixed to both of the upper heat exchanger 30 and the lower heat exchanger 40.

In the present embodiment, the accumulator 50 and the fixing component 60 are fixed to each other by welding, Moreover, as illustrated in FIG. 8, the fixing component 60 and the upper heat exchanger 30 are fixedly screwed to each other. More specifically, a through hole 85 through which a male screw 87 passes is formed in the fixing component 60. For the through hole 85, see FIG. 10 described later. Meanwhile, a female thread into which the male screw 87 is screwed is formed in the end plate 31 of the upper heat exchanger 30. The male screw 87 having passed through the through hole 85 in the fixing component 60 is screwed into the female thread in the end plate 31 of the upper heat exchanger 30, whereby the fixing component 60 and the upper heat exchanger 30 are fixed to each other.

Similarly, as illustrated in FIG. 8, the fixing component 60 and the lower heat exchanger 40 are fixedly screwed to each other. More specifically, a through hole 86 through which a male screw 88 passes is formed in the fixing component 60. For the through hole 86, see FIG. 10 described later. Meanwhile, a female thread into which the male screw 88 is screwed is formed in the end plate 41 of the lower heat exchanger 40. The male screw 88 having passed through the through hole 86 in the fixing component 60 is screwed into the female thread in the end plate 41 of the lower heat exchanger 40, whereby the fixing component 60 and the lower heat exchanger 40 are fixed to each other.

When the fixing component 60 is thus fixed to both of the upper heat exchanger 30 and the lower heat exchanger 40, the accumulator 50 accommodated in the machine chamber 13 is fixed to both of the upper heat exchanger 30 and the lower heat exchanger 40. Therefore, when the fixing component 60 is thus fixed to both of the upper heat exchanger 30 and the lower heat exchanger 40, the accumulator 50 can be prevented from being supported by only one of the upper heat exchanger 30 and the lower heat exchanger 40. In addition, when the fixing component 60 is thus fixed to both of the upper heat exchanger 30 and the lower heat exchanger 40, the vibration of the accumulator 50 generated during transportation or operation of the air-conditioning apparatus can be prevented from acting on only one of the upper heat exchanger 30 and the lower heat exchanger 40. Accordingly, when the fixing component 60 is thus fixed to both of the upper heat exchanger 30 and the lower heat exchanger 40, the upper heat exchanger 30 and lower heat exchanger 40 can be prevented from being damaged.

As illustrated in FIG. 6 and FIG. 7, the outdoor unit 1 according to the present embodiment is configured to sandwich the partition plate 11 between the end plate 31 of the upper heat exchanger 30 and the fixing component 60. Therefore, a through hole through which the male screw 87 passes is formed in the partition plate 11. However, as illustrated in FIG. 8, the fixing component 60 is fixed to the end plate 31 of the upper heat exchanger 30. Similarly, the outdoor unit 1 according to the present embodiment is configured to sandwich the partition plate 11 between the end plate 41 of the lower heat exchanger 40 and the fixing component 60. Therefore, a through hole through which the male screw 88 passes is formed in the partition plate 11. However, as illustrated in FIG. 8, the fixing component 60 is fixed to the end plate 41 of the lower heat exchanger 40.

Note that an attachment position of the fixing component 60 to the accumulator 50 is merely an example. In addition to the accumulator 50, other components are also accommodated in the machine chamber 13. Therefore, the arrangement position of the accumulator 50 in the machine chamber 13 changes according to the positions of the other components accommodated in the machine chamber 13, to prevent the accumulator 50 from interfering with the other components. Therefore, the attachment position of the fixing component 60 to the accumulator 50 differs according to the positions of the other components accommodated in the machine chamber 13.

The above-described fixing structure of the fixing component 60 to the upper heat exchanger 30 is merely an example. For example, the fixing component 60 may be welded or otherwise fixed to the end plate 31 of the upper heat exchanger 30, so that the fixing component 60 is fixed to the upper heat exchanger 30 in a configuration other than screwing with the male screw 87. Alternatively, for example, when the upper heat exchanger 30 has a component other than the end plate 31, the component being capable of fixing the fixing component 60, the fixing component 60 may be fixed to the component. Similarly, the above-described fixing structure of the fixing component 60 to the lower heat exchanger 40 is merely an example. For example, the fixing component 60 may be welded or otherwise fixed to the end plate 41 of the lower heat exchanger 40, so that the fixing component 60 is fixed to the lower heat exchanger 40 in a configuration other than screwing with the male screw 88. Alternatively, for example, when the lower heat exchanger 40 has a component other than the end plate 41, the component being capable of fixing the fixing component 60, the fixing component 60 may be fixed to the component.

Moreover, the outdoor unit 1 according to the present embodiment includes the support component 90, and the accumulator 50 is also supported by the support component 90. More specifically, the lower end portion of the support component 90 is fixed to the bottom plate 16 forming a lower surface portion of the casing 10 by, for example, screwing. In addition, the upper end portion of the support component 90 is fixed to the lower lid component 53 forming a lower surface portion of the accumulator 50 by, for example, welding. Thus, the accumulator 50 is supported by the support component 90 from below, which leads to reduction in a load of the accumulator 50 applied to the upper heat exchanger 30 and the lower heat exchanger 40 through the fixing component 60. Therefore, supporting the accumulator 50 by the support component 90 from below can further prevent the upper heat exchanger 30 and the lower heat exchanger 40 from being damaged.

Subsequently, an example of the fixing component 60 will be described. The fixing component 60 may be an integrally formed component, but in the present embodiment, the fixing component 60 is comprised of the first fixing component 70 and a second fixing component 80.

Figure 9:
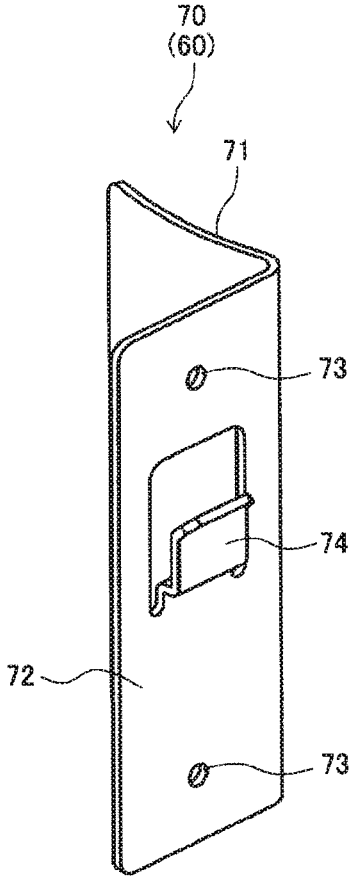
FIG. 9 is a perspective view illustrating a first fixing component in the outdoor unit for an air-conditioning apparatus according to the embodiment of the present disclosure.
Figure 10:
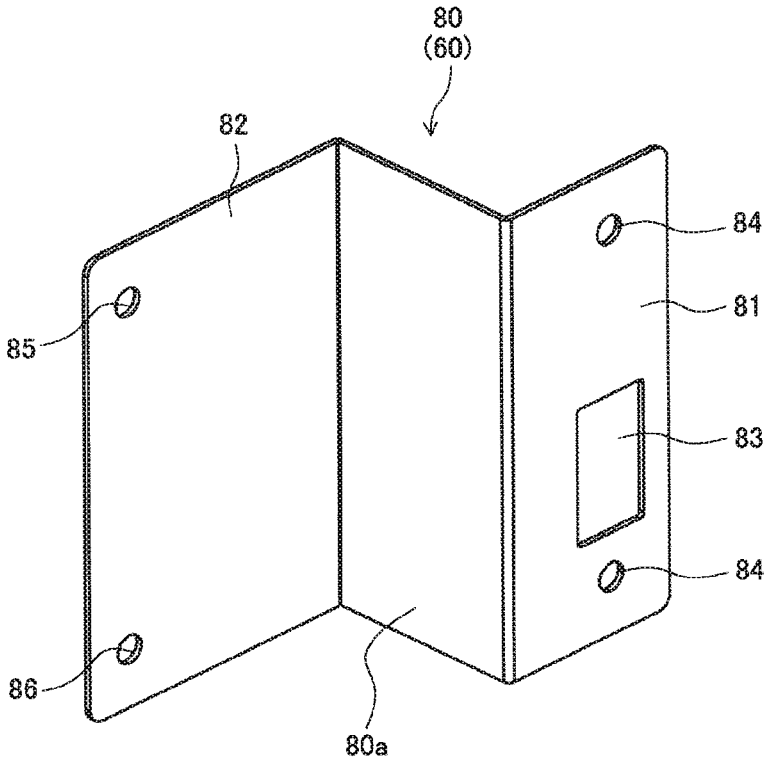
FIG. 10 is a perspective view illustrating a second fixing component in the outdoor unit for an air-conditioning apparatus according to the embodiment of the present disclosure.

FIG. 9 is a perspective view illustrating the first fixing component in the outdoor unit for an air-conditioning apparatus according to the embodiment of the present disclosure, FIG. 10 is a perspective view illustrating the second fixing component in the outdoor unit for an air-conditioning according to the embodiment of the present disclosure. Hereafter, the first fixing component 70 and the second fixing component 80 will be described in detail with reference to FIG. 9 and FIG. 10, and FIGS. 5 to 8 described above.

The first fixing component 70 is a component to be fixed to the accumulator 50. The first fixing component 70 includes a first fixing portion 71 and a second fixing portion 72. The first fixing portion 71 is a plate-shaped portion to be fixed to the accumulator 50. In the present embodiment, the first fixing portion 71 is fixed to an outer peripheral surface of the cylindrical component 52 of the accumulator 50. Therefore, the first fixing portion 71 is formed into an arc shape in a plan view with respect to the outer peripheral surface of the cylindrical component 52. In the present embodiment, the first fixing portion 71 is fixed to the accumulator 50 by welding.

The second fixing portion 72 is a plate-shaped portion to be fixed to the second fixing component 80. In the present embodiment, the second fixing portion 72 and the second fixing component 80 are fixedly screwed to each other with male screws 75. Therefore, for example, a plurality of female threads 73 into which the respective male screws 75 are screwed are formed in the second fixing portion 72. A claw portion 74 is formed in the second fixing portion 72, the claw portion 74 being configured to engage with an opening 83 described later to temporarily fix the first fixing component 70 and the second fixing component 80. In the present embodiment, the second fixing portion 72 protrudes from one end of the first fixing portion 71. That is, the first fixing portion 71 and the second fixing portion 72 form the first fixing component 70 to have a substantially L shape in plan view. Specifically, the plate-shaped member is bent to have a substantially L shape in plan view, thereby forming the first fixing component 70.

The second fixing component 80 is a plate-shaped portion to be fixed to the first fixing component 70. The second fixing component 80 is a component to be fixed to the end plate 31 of the upper heat exchanger 30 and the end plate 41 of the lower heat exchanger 40. The second fixing component 80 includes a third fixing portion 81 and a fourth fixing portion 82, The third fixing portion 81 is fixedly screwed to the second fixing portion 72 of the first fixing component 70 with the male screws 75. Therefore, for example, a plurality of through holes 84 through which the respective male screws 75 are formed in the third fixing portion 81. That is, the male screws 75 have passed through the respective through holes 84 are screwed into the respective female threads 73 in the second fixing portion 72 of the first fixing component 70, whereby the third fixing portion 81 and the second fixing portion 72 of the first fixing component 70 are fixed to each other. Moreover, the opening 83 at which the claw portion 74 is engaged is formed in the third fixing portion 81 to temporarily fix the first fixing component 70 and the second fixing component 80.

The fourth fixing portion 82 is a plate-shaped portion to be fixed to the end plate 31 of the upper heat exchanger 30 and the end plate 41 of the lower heat exchanger 40. A through hole 85 through which the male screw 87 passes is formed in the fourth fixing portion 82. Then, the male screw 87 having passed through the through hole 85 in the fourth fixing portion 82 is screwed into the female thread in the end plate 31 of the upper heat exchanger 30, whereby the fourth fixing portion 82 is fixed to the end plate 31 of the upper heat exchanger 30. Moreover, a through hole 86 through which the male screw 88 passes is formed in the fourth fixing portion 82. Then, the male screw 88 having passed through the through hole 86 in the fourth fixing portion 82 is screwed into the female thread in the end plate 41 of the lower heat exchanger 40, whereby the fourth fixing portion 82 is fixed to the end plate 41 of the lower heat exchanger 40.

In the present embodiment, one end of the third fixing portion 81 is connected to one end of a connecting portion 80a. In plan view, the third fixing portion 81 and the connecting portion 80*a* are connected with inclination at substantially 90 degrees. The other end of the connecting portion 80*a* is connected to one end of the fourth fixing portion 82. In plan view, the connecting portion 80*a* and the fourth fixing portion 82 are connected with inclination at a substantially 90 degrees. That is, the third fixing portion 81, the connecting portion 80*a*, and the fourth fixing portion 82 form the second fixing component 80 to have a substantially Z shape in plan view. Specifically, the plate-shaped member is bent to have a substantially Z shape in plan view, thereby forming the second fixing component 80.

A first factory where the accumulator 50 is manufactured and a second factory where the accumulator 50 is fixed to the heat exchanger 20 may be located at remote places. In this case, it is necessary to transport the accumulator 50 manufactured in the first factory to the second factory. Here, a fixing portion between the accumulator 50 and the fixing component 60 is required to have the air-tightness to prevent the refrigerant from leaking out of the accumulator 50. Also in the present embodiment, the accumulator 50 and the fixing component 60 are fixed to each other by welding, to secure the air-tightness of the fixing portion between the accumulator 50 and the fixing component 60. Therefore, the fixing component 60 is fixed to the accumulator 50 in the first factory, and the accumulator 50 to which the fixing component 60 fixed is transported to the second factory.

Accordingly, when the fixing component 60 protrudes significantly from the accumulator 50 in a state in which the accumulator 50 and the fixing component 60 are fixed to each other, a space required to transport the accumulator 50 is increased, which may lead to an increase in transportation cost. In addition, when the fixing component 60 protrudes significantly from the accumulator 50, the fixing component 60 may be deformed during transportation of the accumulator 50. However, when the first fixing component 70 and the second fixing component 80 form the fixing component 60 as described above, the accumulator 50 can be transported to the second factory in a state in which the first fixing component 70 that is part of the fixing component 60 is fixed to the accumulator 50, Therefore, when the first fixing component 70 and the second fixing component 80 form the fixing component 60, the fixing component 60 can be prevented from protruding significantly from the accumulator 50 when the accumulator 50 is transported. Accordingly, when the first fixing component 70 and the second fixing component 80 form the fixing component 60, the increase in the transportation cost of the accumulator 50 can be prevented, and the deformation of the fixing component 60 can be prevented.

Subsequently, a fixing procedure of the accumulator 50 will be described. The support component 90 fixed to the accumulator 50 is fixed to the bottom plate 16 by, for example, screwing, in a state in which the lower heat exchanger 40 is installed on the bottom plate 16 and the upper heat exchanger 30 is installed above the lower heat exchanger 40. The claw portion 74 in the first fixing component 70 fixed to the accumulator 50 engages with the opening 83 in the second fixing component 80 to temporarily fix the first fixing component 70 and the second fixing component 80, Then, alignment of the female threads 73 in the first fixing component 70 and the through holes 84 in the second fixing component 80 is performed. In addition, alignment of the through hole 85 in the second fixing component 80 and the female thread in the end plate 31 of the upper heat exchanger 30 is performed. Moreover, alignment of the through hole 86 in the second fixing component 80 and the female thread in the end plate 41 of the lower heat exchanger 40 is performed, Then, the male screws 75 having passed through the respective through holes 84 in the second fixing component 80 are screwed into the respective female threads 73 in the second fixing portion 72 of the first fixing component 70, whereby the first fixing component 70 and the second fixing component 80 are fixed to each other. In addition, the male screw 87 having passed through the through hole 85 of the fourth fixing portion 82 is screwed into the female thread in the end plate 31 of the upper heat exchanger 30, whereby the second fixing component 80 and the end plate 31 of the upper heat exchanger 30 are fixed to each other. Moreover, the male screw 88 having passed through the through hole 86 in the fourth fixing portion 82 is screwed into the female thread in the end plate 41 of the lower heat exchanger 40, whereby the second fixing component 80 and the end plate 41 of the lower heat exchanger 40 are fixed to each other. That is, the accumulator 50 is fixed to both of the end plate 31 of the upper heat exchanger 30 and the end plate 41 of the lower heat exchanger 40 through the fixing component 60 comprised of the first fixing component 70 and the second fixing component 80.

As described above, the outdoor unit 1 for an air-conditioning apparatus according to the present embodiment includes the heat exchanger 20. The heat exchanger 20 includes the upper heat exchanger 30 and the lower heat exchanger 40 that are arranged in an up-down direction. The outdoor unit 1 for an air-conditioning apparatus according to the present embodiment includes the accumulator 50 configured to store the refrigerant. In addition, the outdoor unit 1 for an air-conditioning apparatus according to the present embodiment includes the casing 10 in which the inside thereof is partitioned by the partition plate 11 into the air-sending chamber 12 accommodating the heat exchanger 20 therein and the machine chamber 13 accommodating the accumulator 50 therein. Moreover, the outdoor unit 1 for an air-conditioning apparatus according to the present embodiment includes the fixing component 60 configured to be fixed to the heat exchanger 20 and the accumulator 50 so that the accumulator 50 is fixed to the heat exchanger 20. Then, the fixing component 60 is fixed to both of the upper heat exchanger 30 and the lower heat exchanger 40.

In the outdoor unit 1 for an air-conditioning apparatus according to the present embodiment, the accumulator 50 accommodated in the machine chamber 13 is fixed to both of the upper heat exchanger 30 and the lower heat exchanger 40 by the fixing component 60. Therefore, the outdoor unit 1 for an air-conditioning apparatus according to the present embodiment can prevent the accumulator 50 from being supported by only one of the upper heat exchanger 30 and the lower heat exchanger 40. The outdoor unit 1 for an air-conditioning apparatus according to the present embodiment can prevent the vibration of the accumulator 50 generated during transportation or operation of the air-conditioning apparatus from acting on only one of the upper heat exchanger 30 and the lower heat exchanger 40. Accordingly, the outdoor unit 1 for an air-conditioning apparatus according to the present embodiment can prevent the upper heat exchanger 30 and the lower heat exchanger 40 from being damaged.

REFERENCE SIGNS LIST

1 outdoor unit 2 compressor 3 outdoor fan 10 casing 11 partition plate 12 air-sending chamber 13 machine chamber 14 air inlet

14*a* air inlet 14*b* air inlet 15 air outlet 16 bottom plate 20 heat exchanger 30 upper heater exchanger 31 end plate 32 heat transfer fan 33 heat transfer tube 34 connecting pipe 35 upper heat exchanger unit 40 lower heat exchanger 41 end plate 42 heat transfer fin 43 heat transfer tube 44 connecting pipe 45 lower heat exchanger unit 50 accumulator 51 upper lid component 52 cylindrical component 53 lower lid component 54 connecting pipe 60 fixing component 70 first fixing component 71 first fixing portion 72 second fixing portion 73 female thread 74 claw portion 75 male screw 80 second fixing component 80*a* connecting portion 81 third fixing portion 82 fourth fixing portion 83 opening 84 through hole 85 through hole 86 through hole 87 male screw 88 male screw 90 support component

The invention claimed is:

1. An outdoor unit for an air-conditioning apparatus, comprising:

a heat exchanger comprised of an upper heat exchanger and a lower heat exchanger that are arranged in an up-down direction;

an accumulator configured to store refrigerant;

a casing, an inside of which is partitioned by a partition plate into an air-sending chamber accommodating the heat exchanger and a machine chamber accommodating the accumulator; and one fixing component configured to be fixed to the heat exchanger and the accumulator so that the accumulator is fixed to the heat exchanger, wherein the one fixing component is fixed to both of the upper heat exchanger and the lower heat exchanger, the one fixing component includes a first fixing component fixed to the accumulator and a second fixing component fixed to the first fixing component and the heat exchanger, an opening is formed in one of the first fixing component and the second fixing component, and a claw portion configured to engage with the opening is formed in another of the first fixing component and the second fixing component.

2. The outdoor unit for an air-conditioning apparatus of claim 1, wherein the upper heat exchanger includes a first end plate provided in an end portion on a closer side to the machine chamber, the lower heat exchanger includes a second end plate provided in an end portion on a closer side to the machine chamber, and the one fixing component is fixedly screwed to the first end plate and is fixedly screwed to the second plate.

3. The outdoor unit for an air-conditioning apparatus of claim 1, further comprising:

a support component configured to be fixed to a lower surface portion of the casing and a lower surface portion of the accumulator to support the accumulator from below.

* * * * *